US008215728B2

(12) United States Patent
Mehmen

(10) Patent No.: US 8,215,728 B2
(45) Date of Patent: Jul. 10, 2012

(54) STORAGE ENCLOSURE

(75) Inventor: Robert J. Mehmen, Shell Rock, IA (US)

(73) Assignee: Waterloo Industries, Inc., Oak Creek, WI (US)

( * ) Notice: Subject to any disclaimer, the term of this patent is extended or adjusted under 35 U.S.C. 154(b) by 329 days.

(21) Appl. No.: 12/465,124

(22) Filed: May 13, 2009

(65) Prior Publication Data

US 2009/0284112 A1 Nov. 19, 2009

Related U.S. Application Data

(60) Provisional application No. 61/052,803, filed on May 13, 2008.

(51) Int. Cl.
*A47B 88/00* (2006.01)

(52) U.S. Cl. ..... 312/327; 312/290

(58) Field of Classification Search ..... 312/295, 312/309, 327, 328, 323, 139.1, 290; 49/142, 49/198, 203, 204, 143, 145, 103, 163, 168
See application file for complete search history.

(56) References Cited

U.S. PATENT DOCUMENTS

| | | | | |
|---|---|---|---|---|
| 470,089 | A | 3/1892 | Williams | |
| 479,857 | A * | 8/1892 | Tettelbach | 126/190 |
| 631,312 | A | 8/1899 | Macey | |
| 640,078 | A | 12/1899 | Baker | |
| 840,061 | A | 1/1907 | Hofman | |
| 903,668 | A | 11/1908 | Carl | |
| 1,327,977 | A | 1/1920 | Benningon | |
| 1,577,445 | A | 3/1926 | Bremken | |
| 1,608,458 | A | 11/1926 | Barbiers | |
| 1,729,401 | A * | 9/1929 | Richards | 312/264 |
| 1,984,345 | A | 12/1934 | Kennedy | |
| 2,050,833 | A | 8/1936 | Fanarijian | |
| 2,301,856 | A | 11/1942 | Conwell | |
| 2,327,026 | A | 8/1943 | Deuring | |
| 2,590,028 | A | 3/1952 | Miller | |
| 2,704,376 | A | 2/1955 | Berry | |
| 2,895,600 | A | 7/1959 | Nevins | |
| 2,952,497 | A | 9/1960 | Bowden | |
| 3,013,852 | A | 12/1961 | Rockola | |
| 3,079,206 | A | 2/1963 | Glezen | |
| 3,196,480 | A | 7/1965 | Whittorn | |
| 3,464,161 | A | 9/1969 | Jonsson | |
| 3,525,177 | A | 8/1970 | Robinson | |
| 3,620,588 | A | 11/1971 | Ferdinand | |

(Continued)

OTHER PUBLICATIONS

International Search Report and Written Opinion from PCT/US2009/043750, mailed Jul. 2, 2009.

*Primary Examiner* — Darnell Jayne
*Assistant Examiner* — Stanton L Krycinski
(74) *Attorney, Agent, or Firm* — Calfee, Halter & Griswold LLP

(57) ABSTRACT

A storage enclosure includes a housing and first and second doors. The housing defines a front opening for permitting access to an interior of the housing. The first door is connected to the first and second side walls and is upwardly pivotable and inwardly slideable from a closed position covering a lower portion of the front opening to an open position uncovering the lower portion of the front opening. The second door is connected to the housing and is upwardly pivotable from a closed position covering an upper portion of the front opening to an open position uncovering the upper portion of the front opening.

17 Claims, 7 Drawing Sheets

U.S. PATENT DOCUMENTS 3,672,529 A 6/1972 Feddersen et al.
3,748,005 A 7/1973 Chovanec et al.
3,771,847 A 11/1973 Aylworth
3,794,401 A 2/1974 Dean et al.
3,838,586 A * 10/1974 Tennison ..... 70/56
3,860,138 A 1/1975 Lovich et al.
3,888,558 A * 6/1975 Himsl ..... 312/216
3,913,266 A 10/1975 Smith
3,992,816 A 11/1976 Skahill
4,123,879 A 11/1978 Blodee et al.
4,167,298 A 9/1979 Plattner
4,265,502 A 5/1981 Blodee et al.
4,288,134 A 9/1981 Knaack et al.
4,375,907 A 3/1983 Vander Kooi et al.
4,383,721 A 5/1983 Knaack et al.
4,389,078 A * 6/1983 Streit ..... 312/322
4,516,813 A 5/1985 Sekerich
4,591,214 A 5/1986 Reuter et al.
4,600,254 A 7/1986 Whalen
4,925,258 A 5/1990 Ludwig et al.
4,974,912 A 12/1990 Rask et al.
5,061,022 A 10/1991 Meriwether
5,108,165 A 4/1992 Rorke et al.
5,131,449 A 7/1992 Winn et al.
5,222,790 A 6/1993 Latino
5,332,305 A 7/1994 Slivon et al.
5,335,987 A 8/1994 Hodge et al.
5,358,322 A * 10/1994 McLaughlin ..... 312/219
5,399,010 A 3/1995 McClung et al.
5,452,908 A 9/1995 Bencic
5,482,162 A 1/1996 Dickinson
5,520,451 A * 5/1996 Oshima ..... 312/322
5,558,416 A 9/1996 Dumitru
5,645,333 A * 7/1997 Sakurai ..... 312/322
5,678,693 A * 10/1997 Tapp et al. ..... 206/454
5,680,940 A 10/1997 D'Angelo
5,720,535 A 2/1998 Mehman
5,758,937 A 6/1998 Lammens et al.
5,904,411 A 5/1999 Hayakawa
RE36,379 E 11/1999 Slivon et al.
6,056,376 A 5/2000 Yenglin et al.
6,296,337 B1 10/2001 Kawanabe
6,361,132 B2 3/2002 Kawanabe
6,375,235 B1 4/2002 Mehmen
6,394,566 B1 5/2002 Slivon et al.
6,422,386 B1 7/2002 Wiese et al.
6,557,958 B1 * 5/2003 Motta et al. ..... 312/319.2
6,578,938 B2 6/2003 Norman et al.
6,779,856 B2 * 8/2004 Hornberger et al. ..... 312/295
RE40,267 E 4/2008 Mehmen
D574,771 S * 8/2008 Flanigan ..... D13/122
7,455,373 B2 * 11/2008 Bender et al. ..... 312/328
2002/0093275 A1 7/2002 Waisbrod et al.
2003/0160551 A1 8/2003 Beyer et al.
2004/0239216 A1 12/2004 Castillo
2004/0239217 A1 12/2004 Patel
2006/0163981 A1 7/2006 Conrad
2008/0218043 A1 9/2008 Gianelo

* cited by examiner

STORAGE ENCLOSURE

CROSS-REFERENCE TO RELATED APPLICATION

This application claims the benefit of U.S. Provisional Patent Application Ser. No. 61/052,803, entitled "DOOR ASSEMBLY" and filed May 13, 2008, the entire contents of which are incorporated herein by reference, to the extent that they are not conflicting with the present application.

BACKGROUND

Tool chests and cabinets are often provided with a work surface sized and positioned for various types of work, such as, for example, electrical work, machine operations, or the assembly and disassembly of mechanical components, allowing the tool cabinet to serve as a work station for the user. While the tools and work product may be moved from the work surface to a secure location (e.g., a lockable drawer of the tool cabinet, or a separate cabinet or storage room) when the user has suspended his work operations, it may be desirable to keep the tools and work product on the work surface, for example, to save time when the user resumes his work operations. Some tool cabinets have been provided with pivotable lids, covers, or canopies that close over the work surface and lock in this closed position to enclose and secure items left on the work surface.

SUMMARY

The present application contemplates arrangements and configurations for storage enclosures, for example, for use with a tool cabinet. According to an inventive aspect of the present application, a storage enclosure many include a movable door that is pivotable and slideable from a closed position covering an opening in the enclosure, to an open position in which the movable door is received within an interior of the enclosure. According to another inventive aspect of the present application, a storage enclosure may include first and second doors that cover lower and upper portions of an opening in the enclosure when in a closed condition, with the first door being pivotable and slideable to expose the lower portion of the opening, and the second door being pivotable to expose the upper portion of the opening.

Accordingly, in one embodiment of the present application, a storage enclosure includes a housing and first and second doors. The housing defines a front opening for permitting access to an interior of the housing. The first door is connected to the first and second side walls and is upwardly pivotable and inwardly slideable from a closed position covering a lower portion of the front opening to an open position uncovering the lower portion of the front opening. The second door is connected to the housing and is upwardly pivotable from a closed position covering an upper portion of the front opening to an open position uncovering the upper portion of the front opening.

According to another embodiment of the present application, a storage enclosure includes a housing and a movable door moveably connected to the housing. The housing includes first and second opposed side walls, a rear wall extending between rear portions of the side walls, and a top wall extending between top portions of the side walls. The side walls defining an opening for permitting access to an interior of the housing. The movable door at least partially covers the opening in a closed position and is received within the interior of the housing in an open position. A pivot arm includes a first end pivotally connected to a lower portion of the movable door and a second end pivotally connected to one of the first and second side walls. A slide member is pivotally connected to an upper portion of the movable door and is slideably connected to the one of the first and second side walls.

According to still another embodiment of the present application, a storage enclosure includes a housing and first and second doors. The housing includes opposed side walls, a rear wall extending between rear portions of the side walls, and a top wall extending between top portions of the side walls. The side walls include front portions defining a front opening for permitting access to an interior of the housing. The first door is moveably connected to the side walls to cover a lower portion of the front opening in a closed position, and to be received within the interior of the housing in an open position. The second door is moveably connected to the top wall to cover an upper portion of the front opening in a closed position and to uncover the upper portion of the front opening in an open position.

BRIEF DESCRIPTION OF THE DRAWINGS

Features and advantages of the invention will become apparent from the following detailed description made with reference to the accompanying drawings, wherein.

DETAILED DESCRIPTION

This Detailed Description merely describes embodiments of the invention and is not intended to limit the scope of the claims in any way. Indeed, the invention as claimed is broader than and unlimited by the embodiments described herein, and the terms used in the claims have their full ordinary meaning. For example, while the present application describes and shows a door assembly for use with a canopy or storage enclosure on a tool cabinet, the inventive features described in the present application may be applied to many different types of storage arrangements, including, for example, office filing cabinets, laboratory cabinets and work spaces, and retail display counters.

According to an inventive aspect of the present application, an enclosure (such as, for example, a storage enclosure for a tool cabinet) may be provided with a door configured to be slideably received within the enclosure when opened. This may, for example, facilitate ease of movement between the closed and open positions, and/or positioning of the open door for minimized interference with the user. While many different configurations may be provided for opening and closing such a door, in one embodiment, the door may be pivotable from a closed position to a partially open position, and then slideable from the partially open position to a fully open, retracted, or stored position.

Figure 1A:
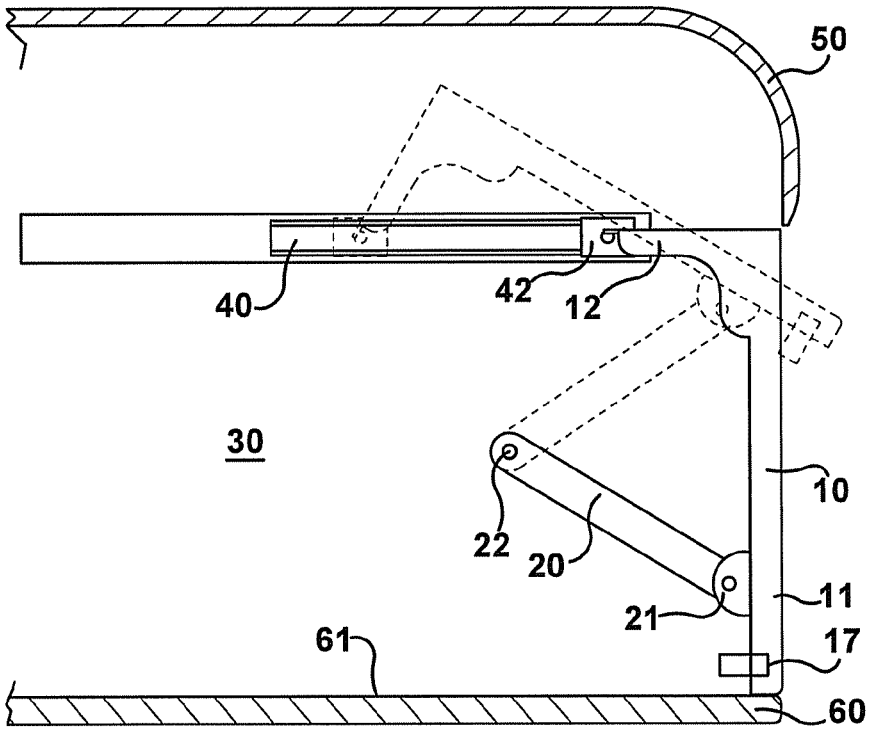
FIG. 1A illustrates a partial cross-sectional schematic side view of a storage enclosure with a door in a closed position, further showing in phantom the door in a partially open position.
Figure 1B:
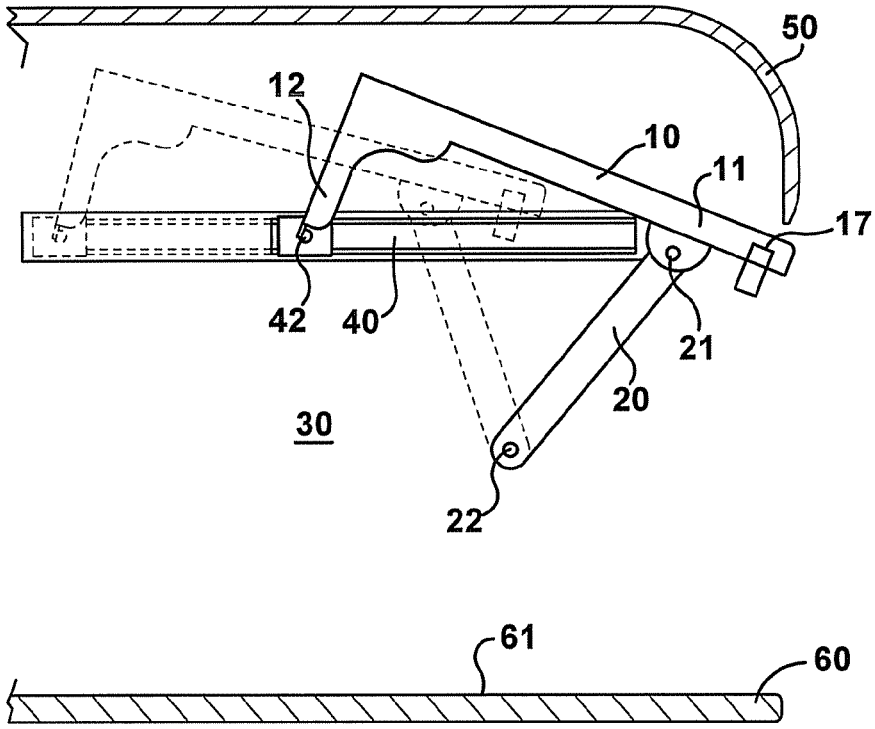
FIG. 1B illustrates a partial cross-sectional schematic side view of the storage enclosure of FIG. 1A, with the door in the partially open position, further showing in phantom the door in a fully open position.
Figure 2:
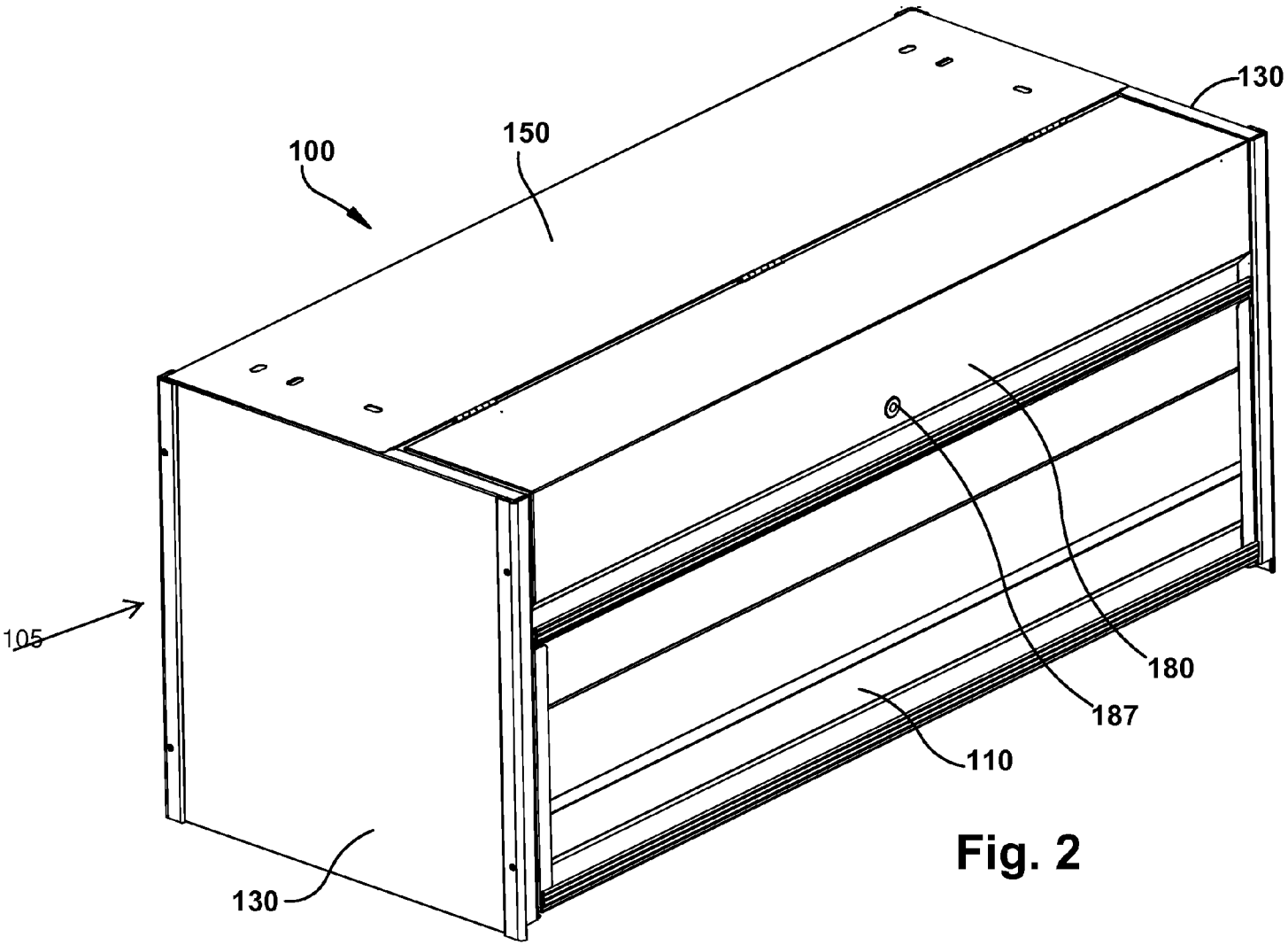
FIG. 2 illustrates an upper perspective view of a storage enclosure, shown in a closed condition.

In one embodiment, as schematically illustrated in FIGS. 1A and 1B, a lower portion 11 of a door 10 is pivotally connected to a first end 21 of a pivot arm 20. A second end 22 of the pivot arm 20 is pivotally connected to a fixed side wall 30 (e.g., a side wall of a canopy housing or other such enclosure). While the second end 22 of the pivot arm 20 may be pivotally connected to the side wall 30 by a sliding pivot member (not shown), in the illustrated embodiment, the second end 22 of the pivot arm 20 is pivotally connected to the side wall 30 at a fixed location. At least a portion of the exemplary door 10 is "L" shaped in cross-section to provide an upper portion 12 that extends substantially perpendicularly from a rear surface of the door 10. In other embodiments (not shown), the door may include other shapes or configurations. The upper portion 12 of the door 10 is pivotally connected to a slide member 42 on a linear slide mechanism 40 (e.g., a conventional ball bearing drawer slide) secured to the side wall 30. While only one end of the door assembly is shown in FIGS. 1A and 1B, it is to be understood that an opposite end of the door 10 may, but need not, include an operating arrangement substantially identical to that shown for the illustrated end of the door 10.

To open the door 10, the door is first pulled outward, pivoting the pivot arm 20 with respect to the side wall 30. The lower portion 11 of the door 10 pivots about the pivot arm 20, and the upper portion 12 of the door 10 pivots about the slide member 42. The slide member 42 slides backwards on the slide mechanism 40, allowing the door 10 to lift to the partially open position, as shown in phantom in FIG. 1A, and in solid lines in FIG. 1B.

To fully open the door 10 from this partially open position, the lifted lower portion 11 of the door 10 is pushed inward, causing the slide member 42 to slide further backward on the slide mechanism 40, as the pivot arm 20 pivots further to orient the door 10 in the fully elevated and retracted position, as shown in phantom in FIG. 1B.

As shown in FIG. 1A, in the closed position, the door 10 spans a front opening between an upper cover member 50 and a lower base member 60 to block access to items placed on an upper surface 61 (e.g., a work surface) of the base member 60. The door 10 may be locked in this closed position using any suitable locking mechanism. For example, the schematically illustrated locking mechanism 17 may include a key cylinder lock operable to engage one or more locking rods (not shown) with corresponding openings in the side walls 30 of the enclosure, thereby preventing movement of the door 10 with respect to the side walls 30.

According to another inventive aspect of the present application, an enclosure having a door configured to be slideably received within the enclosure when opened (e.g., the door 10 of FIGS. 1A and 1B) may further include a second, upper door movable between a closed position and an open position. The second door may, for example, provide the user with a larger opening at the front of the opened enclosure, for example, to facilitate work operations. A second door may also provide additional clearance for opening and closing the first, lower door. In one embodiment, an upper door is pivotable to cover and uncover an upper portion of a front opening in an enclosure housing. In another embodiment, top portions of the housing side walls and a front portion of the top wall may further define a top opening (i.e., a space perpendicular to and continuous with the front opening) to further facilitate access to the interior of the housing. In such an embodiment, an upper door may be configured to cover and uncover both the top opening and the upper portion of the front opening.

While an upper door for an enclosure may be provided with many different operating arrangements (e.g., a sliding door, a rolling door, a removable door, or a sideways pivoting door), in one embodiment, an enclosure includes an upper door hingedly connected to a cover member or top wall of the enclosure for vertical pivoting movement of the upper door between the lowered or closed position and the elevated or opened position. FIGS. 2-5 illustrate an exemplary canopy assembly or storage enclosure 100 for assembly to, or placement on, a work surface (e.g., an upper work surface of a tool bench or tool cabinet, not shown), to protect and secure tools, work product, or other such items placed on the work surface, when such items are not in use. The illustrated storage enclosure 100 includes first and second opposed side walls 130, a rear wall 190, and a cover member or top wall 150 joined to form a housing 105. The side walls 130 define a front opening, and the top portions of the side walls 130 and a front portion of the top wall 150 further define a top opening perpendicular to and continuous with the front opening. A lower door 110 is configured to be slideably received between the side walls 130 and within the housing 105 when opened (see FIGS. 3 and 4) to uncover a lower portion of the front opening. An upper door 180 is pivotally connected to the housing (e.g., connected to the top wall 150) for pivoting movement between a closed position (FIG. 2) covering the top opening and an upper portion of the front opening, and an open position (FIGS. 3 and 4) uncovering the top opening and the upper portion of the front opening. As shown, the upper door 180 may be "L" shaped in cross section to cover both the top opening and the upper portion of the front opening. While any manner, number, and arrangement of pivotable connections may be provided between the upper door 180 and the top wall 150, in the illustrated embodiment, three hinge members 185 are evenly spaced along the length of the upper door 180 to provide uniform pivoting support for the upper door 180. Additionally, as shown, one or more dampening pistons 188 maybe assembled between the upper door 180 and the side walls 130 to dampen movement of the upper door 180 from the open position to the closed position.

The storage enclosure may be configured to accommodate a variety of work operations. For example, pegboards 135, 195 may be provided on the side walls 130 and rear wall 190 of the housing 105 for storing tools, fasteners, and other items. As another example, a conduit port 193 may be provided in the rear wall 190 (or side walls), for example, to facilitate connection of an electrical tool to a power outlet.

Figure 3:
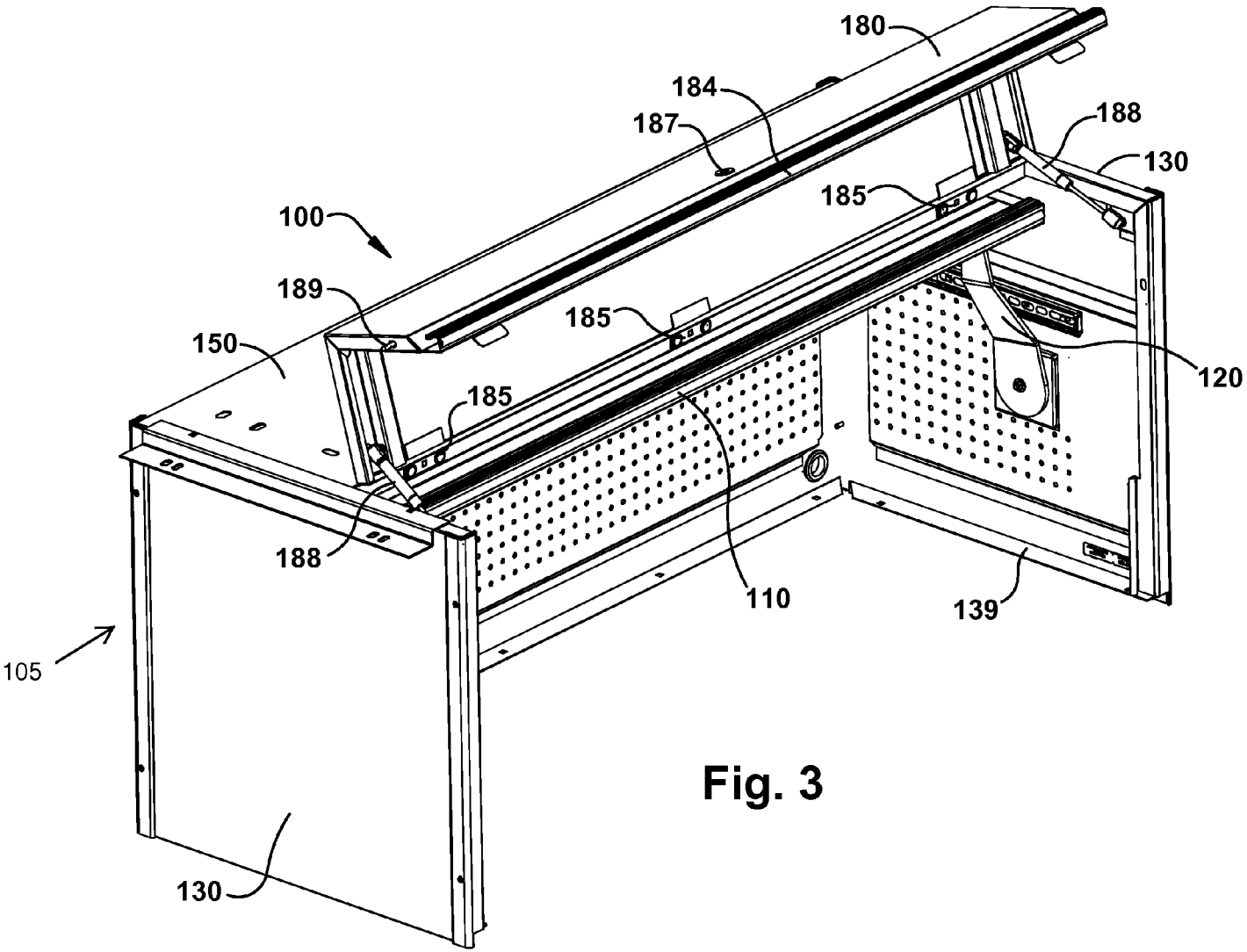
FIG. 3 illustrates an upper perspective view of the storage enclosure of FIG. 2, shown in an open condition.
Figure 4:
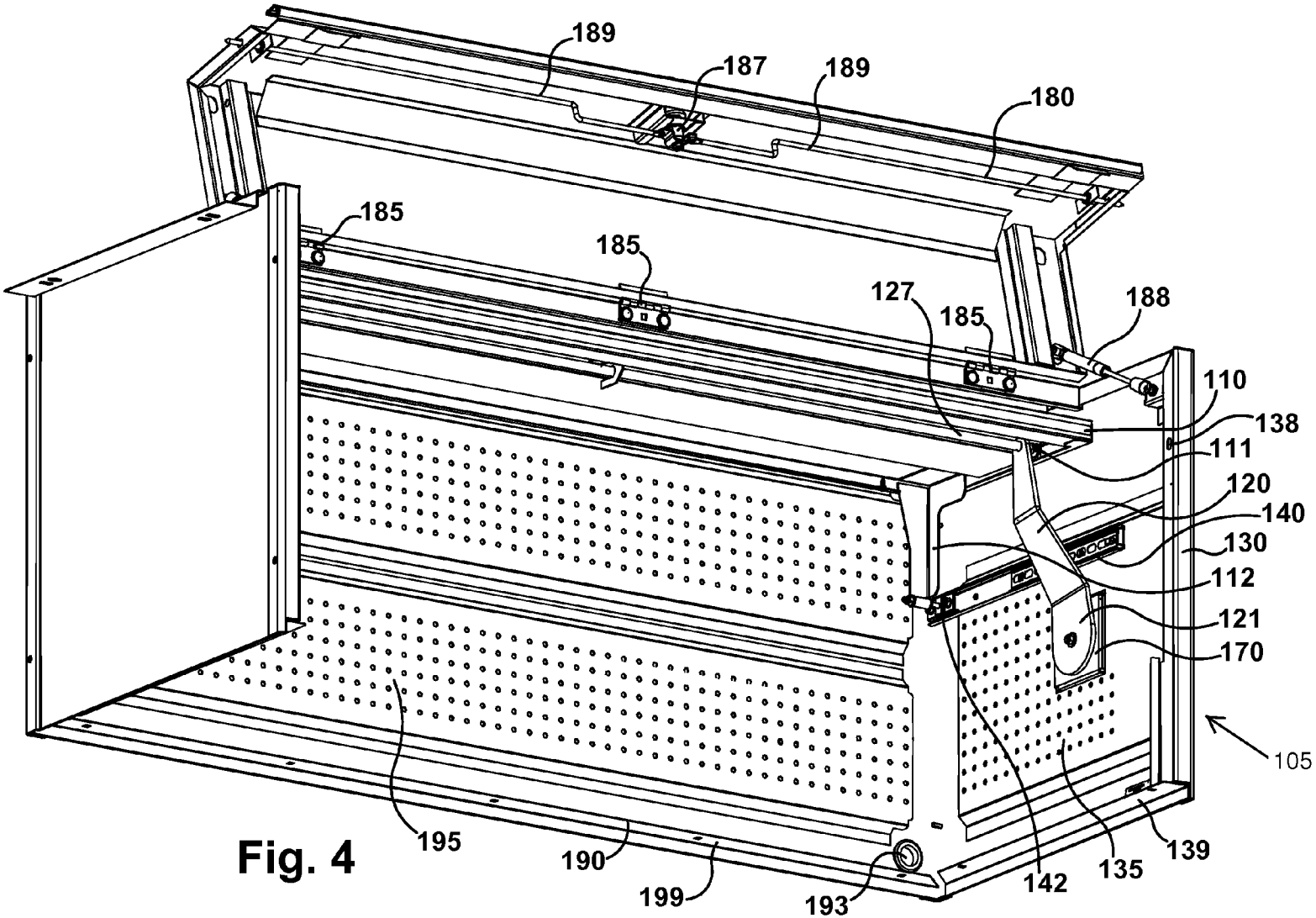
FIG. 4 illustrates a lower perspective view of the storage enclosure of FIG. 2, shown in the open condition.
Figure 5:
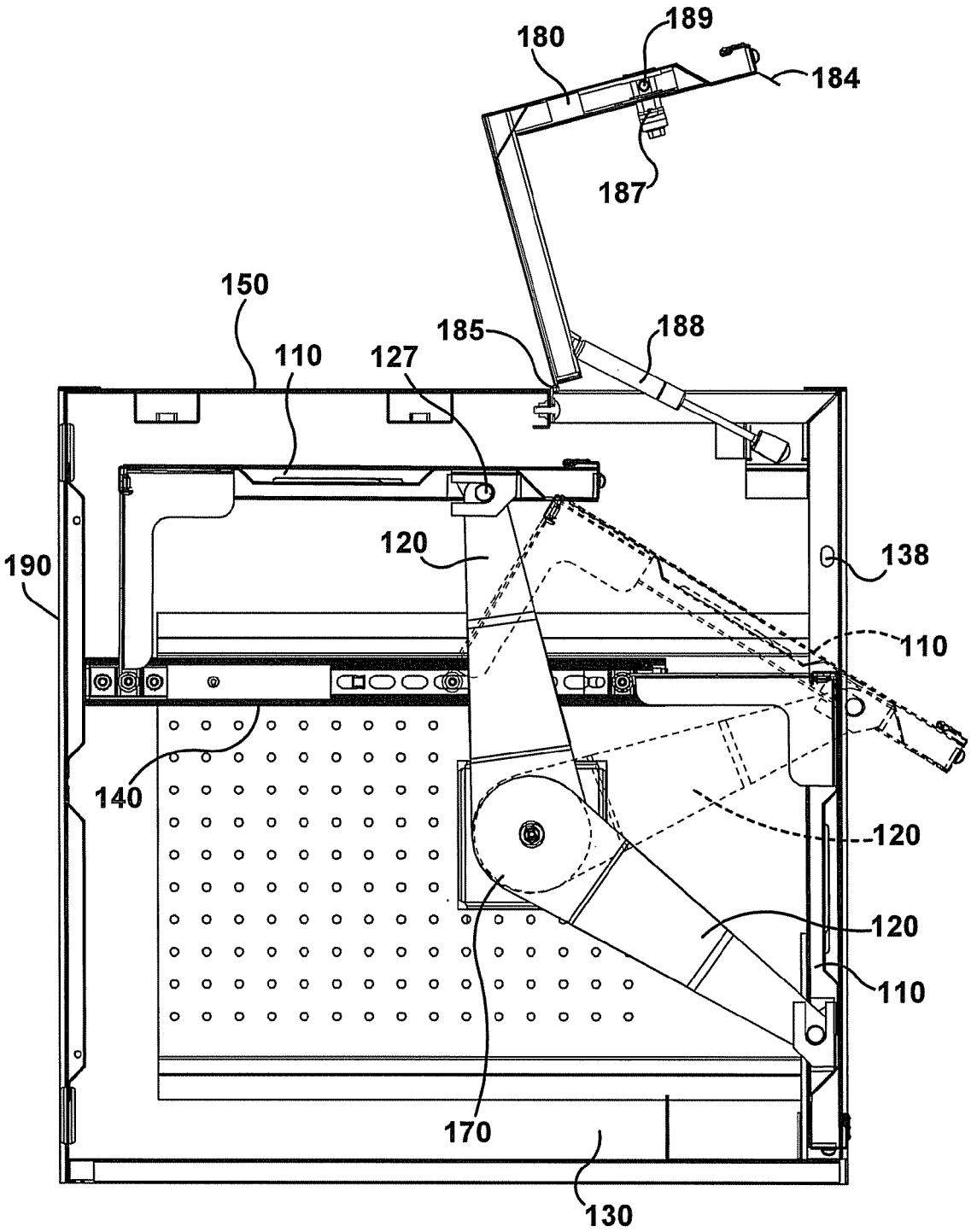
FIG. 5 illustrates a side cross-sectional view of the storage enclosure of FIG. 2, shown with the upper door in an open position, and with the lower door in interposed closed, partially open, and fully open positions.

While only the right end of the door assembly is shown in FIGS. 3-5, it should be understood that the left end of the lower door 110 may, but need not, include an operating arrangement substantially identical to that shown for the illustrated end of the lower door 110. In describing the illustrated embodiment, the left and right sides of the door assembly are assumed to be substantially identical, with corresponding components on each side being identified using the same reference numbers.

In the illustrated embodiment of FIGS. 2-5, a lower portion 111 of the lower door 110 is pivotally connected at both ends to first ends 121 of pivot arms 120. A second end 122 of each pivot arm 120 is pivotally connected to the corresponding housing side wall 130. Upper flange portions 112 of the lower door 110 extend substantially perpendicularly from a rear surface of the door 110 and are pivotally connected to slide members 142 of linear slide mechanisms 140 secured to the side walls 130.

To open the lower door 110, the door is first pulled outward, pivoting the pivot arms 120 with respect to the side walls 130. The lower portion 111 of the lower door 110 pivots about the pivot arms 120, and the upper flange portions 112 of the door 110 pivot about the slide members 142. The slide members 142 slides backwards on the slide mechanisms 140, allowing the lower door 110 to lift to the partially open position, as shown in FIG. 5. To fully open the lower door 110 from this partially open position, the lifted lower portion 111 of the lower door 110 is pushed inward, causing the slide members 142 to slide further backward on the slide mechanisms 140, as the pivot arms 120 pivot further to orient the lower door 110 in the fully elevated and retracted position, as shown in FIGS. 3-5.

While the pivot arms 120 may operate independently in pivoting the lower door 110 between the fully open and closed positions, in one embodiment, a tie rod 127 may provide a rigid connection between the pivot arms 120, for example, to prevent lateral movement of the pivot arms 120 during opening and closing of the lower door 110.

Figure 8:
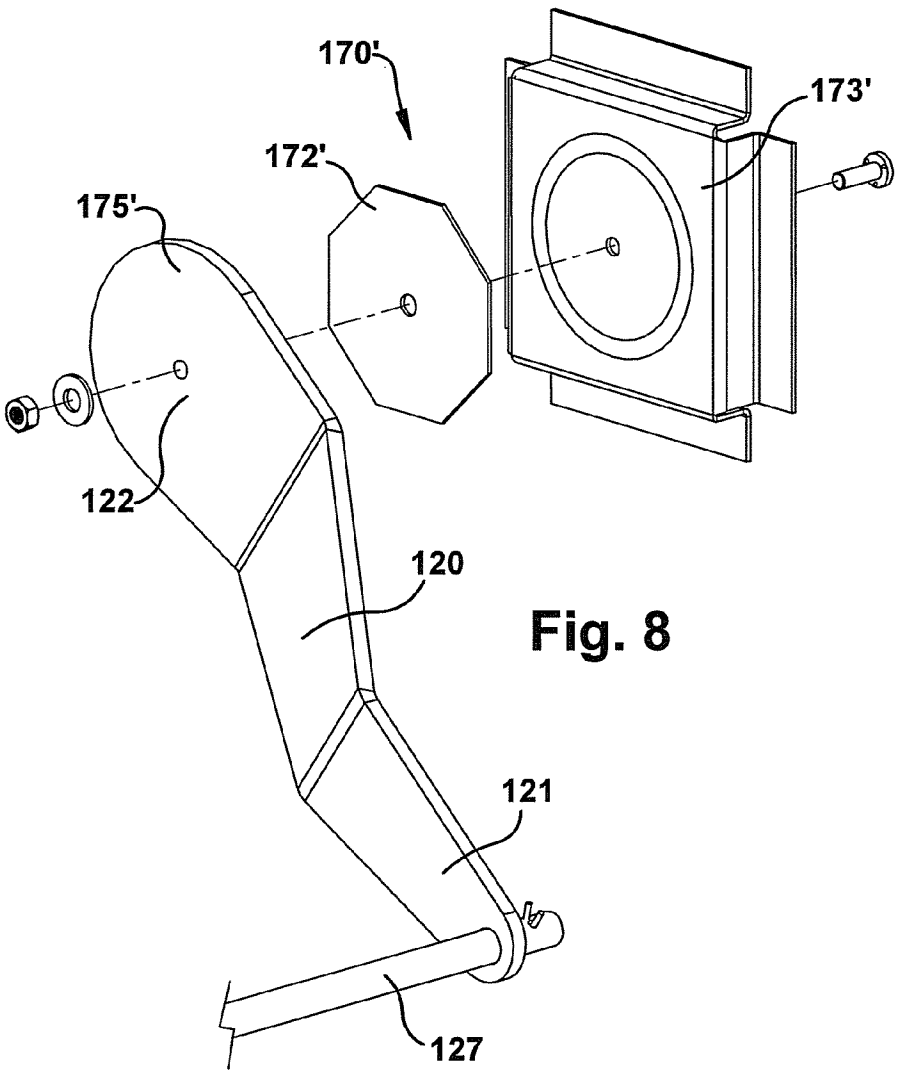
FIG. 8 illustrates a partial perspective view of a pivot arm with a bearing pad swivel arrangement.
Figure 7:
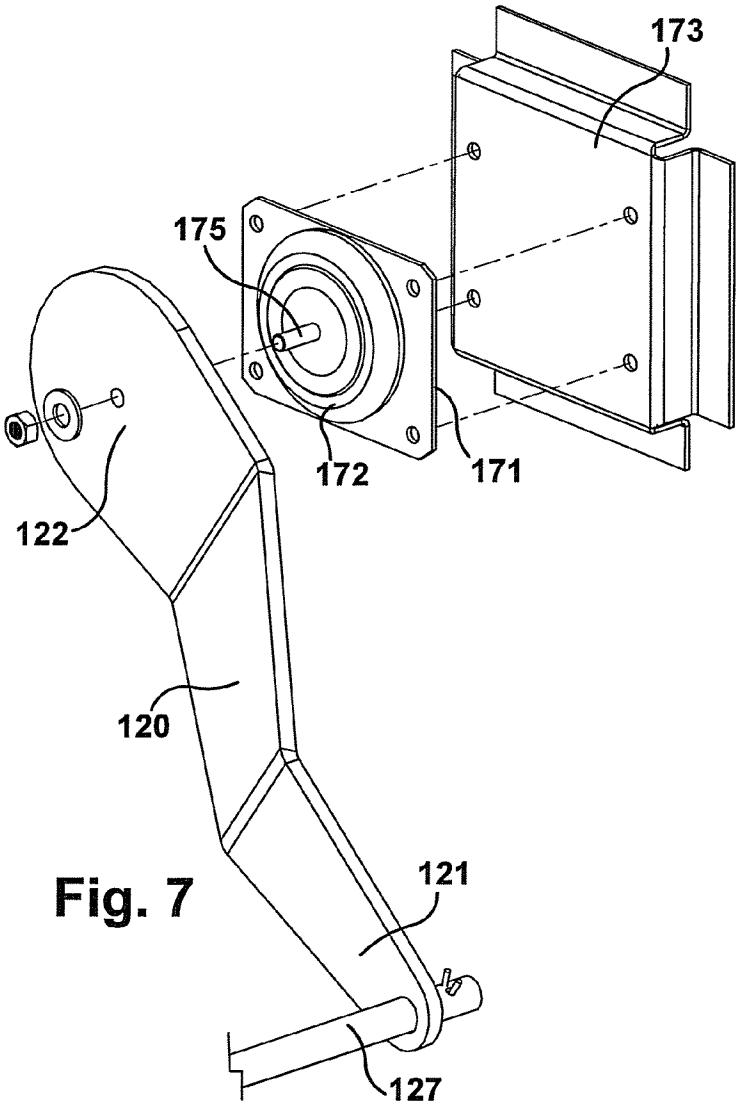
FIG. 7 illustrates a partial perspective view of a pivot arm with a ball bearing swivel arrangement.

Many different types of pivotable connections may be provided between the second ends 122 of the pivot arms 120 and the housing side walls 130. As shown in FIGS. 3-5, the illustrated embodiment includes a swivel assembly 170 connecting each pivot arm 120 to a corresponding side wall 130 for pivotal movement of the pivot arms. In one such swivel assembly 170, as shown in FIG. 7, a ball bearing swivel plate 171 having a ring shaped cavity 172 retaining rolling ball bearings (not shown) is affixed to a side wall (for example, through a raised mounting plate 173). The second end 122 of the pivot arm 120 is affixed to a rotatable center rod 175 for pivoting movement of the pivot arm 120 and rod 175 with respect to the swivel plate 171, to facilitate smooth pivoting movement of the pivot arms when the lower door 110 is opened and closed. As another example, as shown in FIG. 8, a swivel assembly 170' includes a bearing pad or disc 172' (for example, a nylon disc) disposed between a bearing retainer 175' affixed to the pivot arm 120 and a mounting plate 173' affixed to a housing side wall to facilitate pivoting movement of the pivot arms. In one such embodiment, the torque or tension on the bearing disc 172' may be adjusted to allow the user to adjust resistance to movement, for example, to prevent the lower door 110 from slamming against the work surface during closure.

Figure 6:
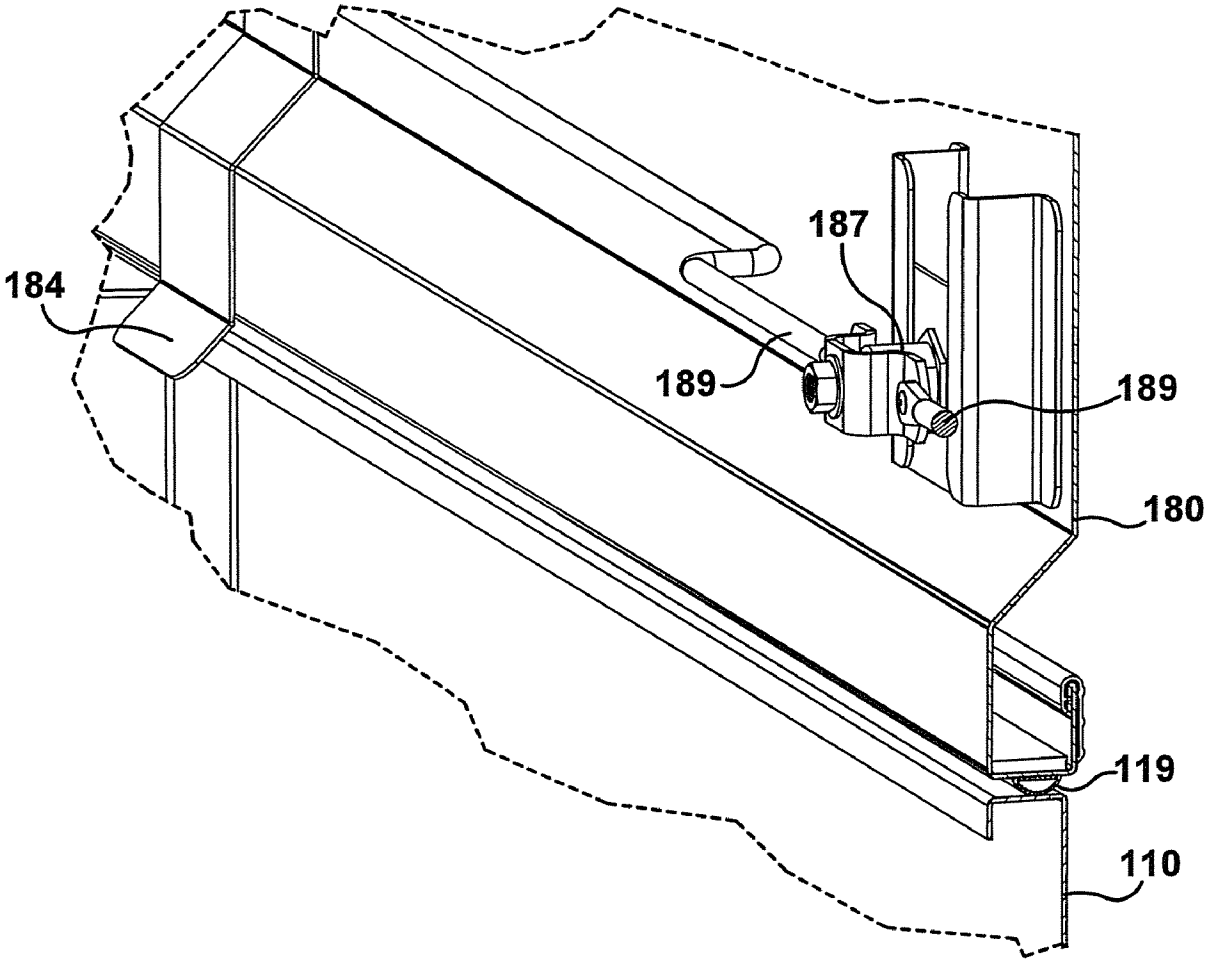
FIG. 6 illustrates a partial side cross-sectional perspective view of upper and lower doors of a storage enclosure, shown in a closed condition.

As shown in FIG. 5, in the closed position, the lower door 110 spans a front opening between a bottom edge of the closed upper door 180 and a base flange portion 139, 199, of the side walls 130 and rear wall 190, which is configured to affix the enclosure 100 to an upper surface of a tool cabinet (not shown). When the upper door 180 and lower door 110 are both in the closed position (see FIG. 2), the doors 180, 110 prevent access to items placed on an upper surface (e.g., a work surface) of the tool cabinet (not shown). The doors 180, 110 may be locked in this closed position using any suitable locking mechanism. While each of the doors 180, 110 may be provided with its own locking mechanism, in one embodiment, a storage enclosure may be configured such that one locking mechanism serves to secure both doors 180, 110 in the closed position. In the illustrated embodiment, as shown in FIGS. 4 and 5, the upper door 180 includes a key cylinder lock 187 operable to engage locking rods 189 with corresponding openings 138 in the housing side walls 130, thereby preventing movement of the upper door 180 with respect to the side walls 130. As best shown in FIG. 6, a bottom edge of the upper door 180 may include a flange 184 positioned to engage an upper edge of the lower door 110 to prevent upward and inward opening movement of the lower door 110 when the upper door 180 is in the closed position. A gasket 119 may be provided on the upper edge of the lower door 110 to provide a snug fit between the upper and lower doors 180, 110 in the closed position.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

I claim:

1. A storage enclosure comprising:

a housing including first and second opposed side walls, a rear wall extending between rear portions of the side walls, and a top wall extending between top portions of the side walls, the side walls defining an opening for permitting access to an interior of the housing;

a movable door moveably connected to the housing, the movable door covering a lower portion of the housing interior in a closed position, with an upper edge of the closed movable door defining an upper end of the lower portion of the housing interior, the movable door being received entirely within an upper portion of the housing interior in an open position, the upper portion of the housing interior being disposed above the lower portion of the housing interior;

a pivot arm having a first end pivotally connected to a lower portion of the movable door and a second end pivotally connected to one of the first and second side walls;

a slide member pivotally connected to an upper portion of the movable door and slideably connected to the one of the first and second side walls; and a second door moveably connected to the housing, the second door covering an upper portion of the opening in a closed position, wherein the second door secures the movable door in the closed position when the second door is in the closed position.

2. The storage enclosure of claim 1, wherein the second door is pivotally connected to the top wall.

3. The storage enclosure of claim 1, wherein the second door comprises a flange portion positioned to engage an upper edge of the movable door to prevent upward and inward opening movement of the movable door when the second door is in the closed position.

4. The storage enclosure of claim 1, wherein the second door includes a locking mechanism operable to lockingly engage the first and second side walls when the second door is in the closed position.

5. The storage enclosure of claim 1, wherein the second end of the pivot arm is pivotally connected to the one of the first and second side walls by a swivel plate.

6. The storage enclosure of claim 1, wherein the top portion of the movable door comprises a bracket extending substantially perpendicularly from a rear surface of the movable door.

7. The storage enclosure of claim 1, comprising a first pivot arm connecting a first end of the movable door to the first side wall, and a second pivot arm connecting a second end of the movable door to the second side wall.

8. The storage enclosure of claim 1, wherein the second end of the pivot arm pivotally connected to the one of the first and second side walls at a fixed location.

9. A storage enclosure comprising:

a housing including opposed side walls, a rear wall extending between rear portions of the side walls, and a top wall extending between top portions of the side walls, the side walls including front portions defining a front opening for permitting access to an interior of the housing;

a first door moveably connected to the side walls, the first door covering a lower portion of the front opening in a closed position, with an upper edge of the closed first door defining an upper end of the lower portion of the front opening, the first door being received within the interior of the housing in an open position; and a second door moveably connected to at least one of the top wall and the side walls, the second door covering an upper portion of the front opening, above the lower portion of the front opening, in a closed position and uncovering the upper portion of the front opening in an open position;

wherein when the first door moves from the closed position to the open position, at least a portion of the first door passes through the upper portion of the front opening, and the second door blocks movement of the first door from the closed position to the open position when the second door is in the closed position, and the second door permits movement of the first door from the closed position to the open position when the second door is in the open position.

10. The storage enclosure of claim 9, wherein the top portions of the side walls and a front portion of the top wall further defining a top opening perpendicular to and continuous with the front opening, the second door covering the top opening in the closed position and uncovering the top opening in the open position.

11. The storage enclosure of claim 9, wherein at least one of the first and second doors includes a locking mechanism operable to lockingly engage the first and second side walls when the at least one of the first and second door is in the closed position.

12. The storage enclosure of claim 9, wherein the second door secures the first door in the closed position when the second door is in the closed position.

13. The storage enclosure of claim 9, wherein the second door comprises a flange portion positioned to engage an upper edge of the first door to prevent upward and inward opening movement of the first door when the second door is in the closed position.

14. The storage enclosure of claim 9, wherein the second door is hingedly connected to the top wall for pivoting movement between the closed position and the open position.

15. The storage enclosure of claim 9, further comprising a pivot arm having a first end pivotally connected to a lower portion of the first door and a second end pivotally connected to one of the first and second side walls, and a slide member pivotally connected to an upper portion of the first door and slideably connected to the one of the first and second slide walls.

16. The storage enclosure of claim 9, wherein the first door is pivotable and slideable from the closed position to the open position.

17. A storage enclosure comprising:

a housing including first and second opposed side walls, a rear wall extending between rear portions of the side walls, and a top wall extending between top portions of the side walls, the side walls defining an opening for permitting access to an interior of the housing;

a movable door moveably connected to the housing, the movable door covering a lower portion of the housing interior in a closed position, with an upper edge of the closed movable door defining an upper end of the lower portion of the housing interior, the movable door being received entirely within an upper portion of the housing interior in an open position, the upper portion of the housing interior being disposed above the lower portion of the housing interior;

a pivot arm having a first end pivotally connected to a lower portion of the movable door and a second end pivotally connected to one of the first and second side walls;

a slide member pivotally connected to an upper portion of the movable door and slideably connected to the one of the first and second side walls; and a second door moveably connected to the housing, the second door partially covering the opening in a closed position, wherein the second door comprises a flange portion positioned to engage an upper edge of the movable door to prevent upward and inward opening movement of the movable door when the second door is in the closed position.

* * * * *